US005726532A

United States Patent [19]

Wittig et al.

[11] Patent Number: 5,726,532

[45] Date of Patent: Mar. 10, 1998

[54] HIGH-PRESSURE DISCHARGE LAMP AND PROCESS FOR PRODUCING IT

[75] Inventors: Christian Wittig, Munich; Dieter Lang, Holzkirchen, both of Germany

[73] Assignee: Patent-Treuhand-Gesellschaft F. Elektrische Gluehlampen mbH, Munich, Germany

[21] Appl. No.: 556,912

[22] PCT Filed: May 25, 1994

[86] PCT No.: PCT/DE94/00600

§ 371 Date: Nov. 20, 1995

§ 102(e) Date: Nov. 20, 1995

[87] PCT Pub. No.: WO94/28576

PCT Pub. Date: Dec. 8, 1994

[30] Foreign Application Priority Data

May 25, 1993 [DE] Germany ..... 43 17 369.1

[51] Int. Cl.[6] ..... H01J 61/34; H01J 9/26

[52] U.S. Cl. ..... 313/636; 313/25; 313/573; 313/571

[58] Field of Search ..... 313/25, 623, 624, 313/625, 572, 573, 570, 633, 493, 636, 571

[56] References Cited

U.S. PATENT DOCUMENTS 5,196,759 3/1993 Parham et al. ..... 313/112
5,229,681 7/1993 Gordin et al. ..... 313/25
5,572,091 11/1996 Langer et al. ..... 313/636
5,589,734 12/1996 Deisenhofer et al. ..... 313/636

FOREIGN PATENT DOCUMENTS 2 026 850 4/1991 Canada .
0 465 083 A3 1/1992 European Pat. Off. .
0 570 068 A1 11/1993 European Pat. Off. .

*Primary Examiner*—Ashok Patel
*Attorney, Agent, or Firm*—Frishauf, Holtz, Goodman, Langer & Chick, P.C.

[57] ABSTRACT

The invention relates to a high-pressure discharge lamp with an outer bulb surrounding the discharge vessel, and to a process for producing a high-pressure discharge lamp. The outer bulb (1) comprises a glass that has a low viscosity and in particular a lower softening temperature than the quartz glass of the discharge vessel (2), and is melted directly onto the ends (*5a, 5b*) of the discharge vessel (2), which is sealed on both ends. As the glass for the outer bulb, a quartz glass doped with viscosity-lowering additives, in particular alkaline-earth metal borates, is used, while the discharge vessel comprises undoped quartz glass. In addition, the quartz glass of the outer bulb is preferably doped with rare earth metal additives that absorb UV radiation. To avoid projection errors, the axis of symmetry of the substantially rotationally symmetrical outer bulb (1) is shifted parallel relative to the path connecting the electrode heads by an amount that, for a horizontal lamp operating position, is defined by the convection-dictated curvature of the discharge arc.

20 Claims, 3 Drawing Sheets

HIGH-PRESSURE DISCHARGE LAMP AND PROCESS FOR PRODUCING IT

FIELD OF THE INVENTION

The invention relates to a high-pressure discharge lamp as having a discharge vessel of quartz glass, surrounded by an outer bulb for producing such a high-pressure discharge lamp.

In particular, it relates to a high-pressure discharge lamp that is suitable for an optical projection system, such as for an automobile headlight.

BACKGROUND

European Patent Disclosure EP-A 0 570 068, Westemeyer et al., discloses such a lamp. It is used as a light source for an automobile headlight. This high-pressure discharge lamp has a quartz glass discharge vessel, sealed off on both ends on molybdenum fusing foils, with two electrodes aligned axially in it that are each fused into one end of the discharge vessel. An outer bulb of quartz glass surrounds the discharge vessel. FIG. 3 of this disclosure shows a high-pressure discharge lamp with a substantially rotationally symmetrical outer bulb, which is located coaxially with the discharge vessel and which outside the molybdenum fusing foils is fused with the sealed ends of the discharge vessel. With this type of fastening of the outer bulb, the danger is that when the outer bulb is fused to the discharge vessel ends, the molybdenum fusing of the discharge vessel will be damaged, and then the discharge vessel is no longer sealed in gas-tight fashion. This danger can be reduced in lamps in accordance with EP-A 0 570 068 by providing fusing of the outer bulb of the discharge vessel a sufficient distance away from the molybdenum foil seal.

European Patent Disclosure EP-A 0 465 083, Davenport et al., likewise describes a high-pressure discharge lamp of the type referred to. This high-pressure discharge lamp has a quartz glass discharge vessel, sealed off on two ends by means of molybdenum fusing seals, with two electrodes oriented axially inside it that are each fused into one end of the discharge vessel. Outside the fused-in molybdenum foils, the discharge vessel ends each have a platelike thickened portion, with which a quartz glass outer bulb surrounding the discharge vessel is fused in gas-tight fashion. This type of outer bulb fixation to the discharge vessel by means of the platelike thickened portions is comparatively complicated and expensive. Moreover, these platelike thickened portions must also be far enough away from the fused-in molybdenum foils that they do not threaten the sealing of the discharge vessel.

THE INVENTION

It is an object of the invention to provide a high-pressure discharge lamp as generically described above, especially being of small dimension, e.g. a low-wattage high-pressure discharge lamp up to an electrical power of approximately 150 W, which has a very simple and highly reliable attachment of the outer bulb to the discharge vessel, and to disclose a process for producing such a high-pressure discharge lamp.

Briefly, the high-pressure discharge lamps of the invention are equipped with an outer bulb, whose glass has lower viscosity and hence a lower softening temperature than the quartz glass of the discharge vessel and is fused to the pinch seals of the discharge vessel, preferably in the vicinity of the remote ends of molybdenum foils in the pinch seals. As a result, when the outer bulb is fused by melting to the discharge vessel, only the outer bulb glass but not the quartz glass of the discharge vessel softens. Because of the different softening temperatures, there is hence no danger that the sealed discharge vessel ends will be melted again and damaged when the outer bulb is fused on. It is even possible for the outer bulb to be fused directly to the pinch seals of the discharge vessel ends, without impairing the seal of the discharge vessel ends, which seal includes the molybdenum foils embedded in the seal. As a result, the structural length of the high-pressure discharge lamp according to the invention can be shortened, in comparison with the lamps cited above as prior art.

Advantageously, the outer bulb is made of a soft quartz glass provided with viscosity-reducing additives, while the thermally more severely stressed discharge vessel is of undoped quartz glass. Soft quartz glasses, compared with a pure, undoped quartz glass (silicic acid content of approximately 99.99 mol %), have an established softening range at markedly lower temperatures and can therefore be processed more easily and economically in terms of energy than pure quartz glass. Examples of such soft quartz glasses that are advantageously usable as outer bulb glass are disclosed in European Patent Application EP-PA 93118937.7, to which U.S. Pat. No. 5,532,195, Weiss et al., and U.S. Ser. No. 08/595,408, Weiss et al., correspond. As viscosity dopants, alkaline earth metal borates are above all used in the quartz glass. Advantageously, however, the outer bulb glass also contains additives of rare earth metal compounds, which reduce the transparency of the outer bulb glass in the ultraviolet (UV) spectral range in order to reduce the UV emissions of the high-pressure discharge lamp. Since these rare earth metal compounds that absorb UV rays themselves lower the viscosity of the outer bulb glass, it is possible, given an adequate content of rare earth metal compounds in the outer bulb glass, or in other words With a proportion by weight of these rare earth metal compounds of more than approximately 0.5 weight %, to dispense with the viscosity-reducing alkaline earth metal borates referred to at the beginning.

The ease of securing the outer bulb to the discharge vessel in high-pressure discharge lamps used in automobile headlights has an especially advantageous effect, because no additional retaining or frame parts, which could impair light emission, are needed. High-pressure discharge lamps used in automobile headlights are typically operated in a horizontal position, or in other words with the discharge path extending horizontally, and thus the discharge arc in the gravity field of the earth undergoes a crescent-shaped upward curvature as a result of convection. To avoid projection errors in the headlight, the axis of symmetry of the substantially rotational symmetrical outer bulb of the high-pressure discharge lamp of the invention is shifted parallel from the connecting path of the ends of the electrodes toward the discharge side. The amount of parallel shifting is approximately equivalent to the mean deflection of the discharge arc out of the imaginary path connecting the electrode ends. In this way, it is assured that the outer bulb wall will not produce any mirror images of the curved discharge arc, which would cause interfering reflections in the reflector and would result in light losses.

Advantageously, the axis of the outer bulb extends through the center point or maximum brightness point of the discharge arc, which point is used for the projection system. In low-power high-pressure discharge lamps (below 100 W), which are used in automobile headlights, the deflection of the discharge arc out of the discharge path, or in other words the connecting path between the discharge-side ends of the electrodes, is approximately 0.3 mm to 1.0 mm.

The eccentric position of the outer bulb relative to the path connecting the discharge-side electrode ends, or relative to the discharge vessel axis—typically, the electrodes extend in the discharge vessel axis—can be assured relatively simply by fixing the outer bulb and the discharge vessel, when the outer bulb is fused on, in clamping chucks of a glass lathe that are located eccentrically relative to one another.

DRAWINGS

The invention is described in further detail below in terms of a preferred exemplary embodiment. Shown are:

FIG. 1*a*, a schematic illustration of the axial location of the electrodes in the outer bulb with the discharge arc, and its mirror image produced by the outer bulb wall (without discharge vessel);

FIG. 1*b*, a schematic illustration of the eccentric location of the electrodes with respect to the outer bulb in the lamps of the invention (without discharge vessel);

FIG. 2, a schematic illustration of a high-pressure discharge lamp according to the invention, with an exaggeratedly shown eccentric location of the outer bulb;

FIG. 3*a* illustrates the assembly of the outer bulb in a high-pressure discharge lamp according to the invention;

FIG. 3*b* illustrates the assembly of the outer bulb in a high-pressure discharge lamp according to the invention.

DETAILED DESCRIPTION

Figure 1A:
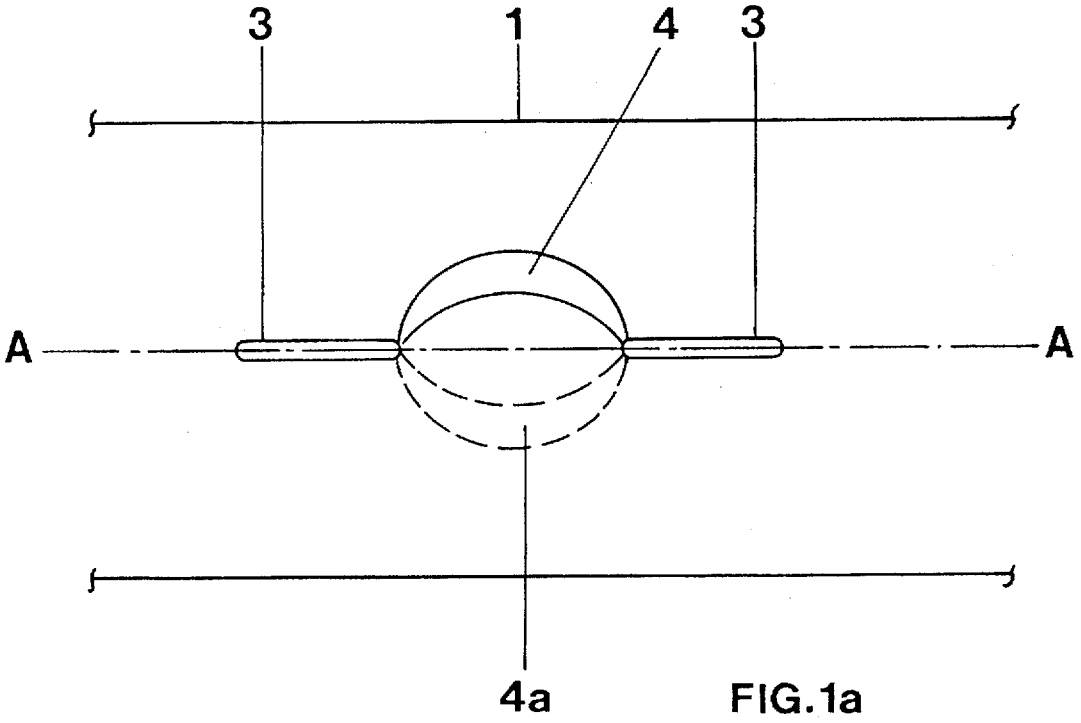
Figure 1B:
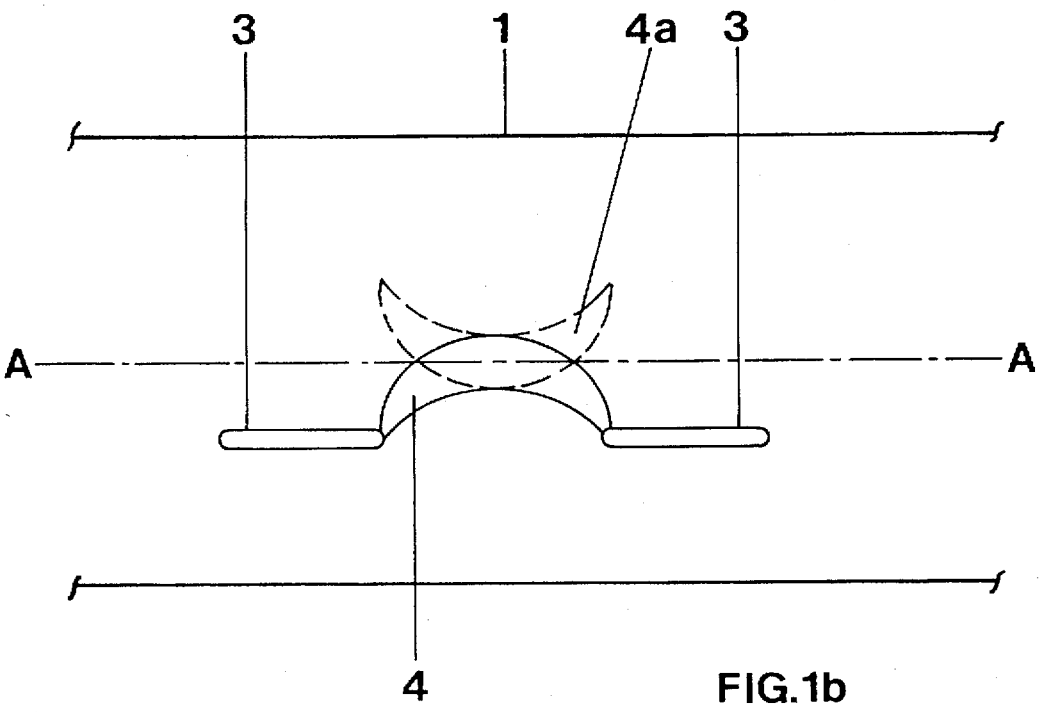

FIGS. 1*a* and 1*b* illustrate the creation and avoidance of mirror images by the outer bulb wall. They are shown highly schematically. Also, in both figures, for the sake of simplicity, the discharge vessel has not been shown. In FIG. 1*a*, the two electrodes 3 are located horizontally in the axis A—A of the outer bulb 1. The discharge-side ends, toward one another, of the electrodes 3 define a discharge path located in the outer bulb axis A—A. In the operating state, a convection-dictated upwardly curved discharge arc 4 develops between the discharge-side ends of the electrodes 3. Below the axis A—A, the outer bulb wall produces a real mirror image 4*a* of the discharge arc 4, which causes losses of light and interfering reflections when such a lamp is used in a projection system.

FIG. 1*b* shows the location of the outer bulb 1 and electrodes 3 in a high-pressure discharge lamp according to the invention. The electrodes 3 are located eccentrically in the outer bulb 1, so that the discharge path extends parallel to the outer bulb axis A—A, but does not coincide with it. The spacing between the electrodes or of the discharge path and the outer bulb axis is chosen such that the outer bulb axis A—A passes through the center or maximum point of brightness of the discharge arc, and the real mirror image 4*a* is largely made to coincide with the discharge arc 4. As a result, the center or maximum point of brightness of the discharge arc 4 coincides with its mirror image. The term center or maximum point of brightness is used to designate the location, on the middle vertical line between the two discharge-side electrode ends, that has the highest light density in the discharge arc 4.

Figure 2:
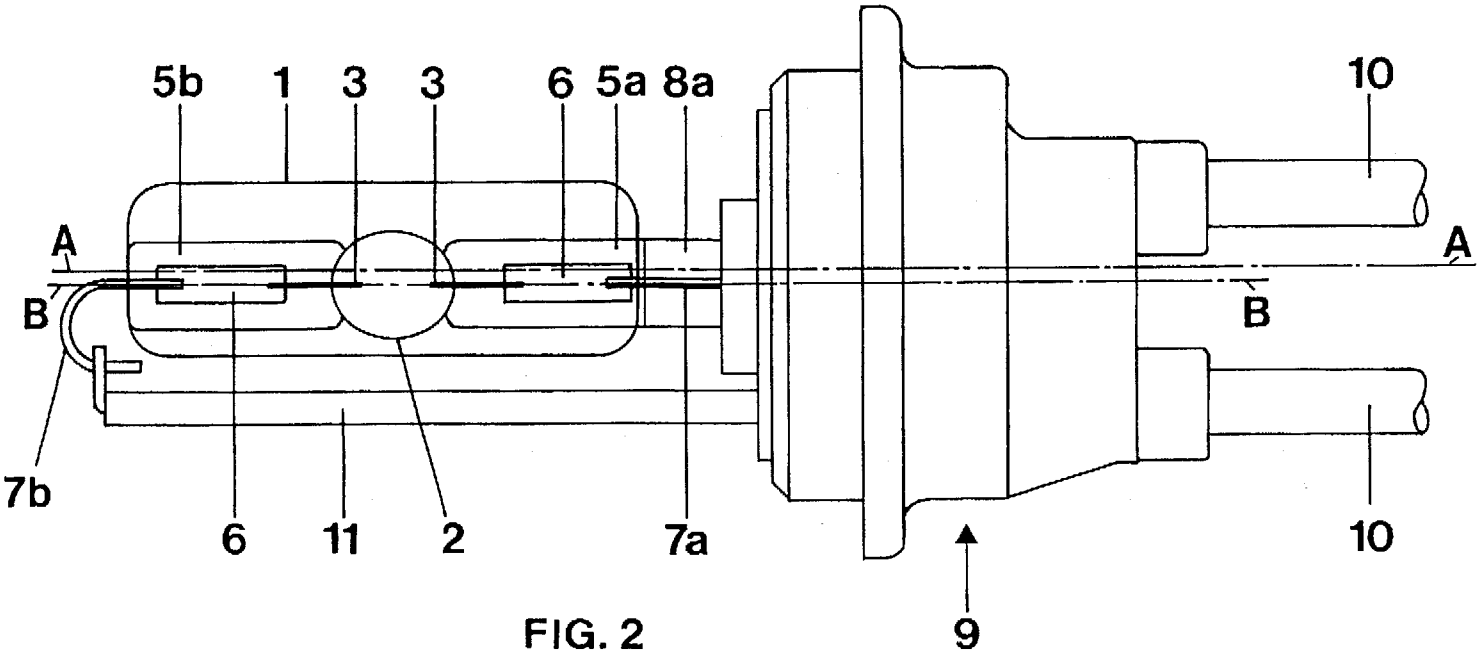

FIG. 2 shows a high-pressure discharge lamp according to the invention. In this exemplary embodiment, the lamp is a halogen metal vapor lamp, with a base on one end and with an electrical power consumption of approximately 35 W, which is preferably used in automobile headlights. This lamp has a substantially axially symmetrical discharge vessel 2, sealed on two ends, which is surrounded by a substantially rotationally symmetrical outer bulb 1. The discharge vessel 2 has a discharge chamber with an ionizable filling enclosed in it in gas-tight fashion, as well as two opposed pinched ends 5*a*, 5*b* Axially located electrodes 3 protrude into the discharge chamber. Both electrodes 3 are electrically conductively connected to a power lead-in 7*a*, 7*b* via a fused-in molybdenum foil 6.

In accordance with a feature of the invention, the outer bulb 1 is secured directly to the pinch seals 5*a*, 5*b* of the discharge vessel 2, in the immediate vicinity of the end of the molybdenum foils 6 remote from the discharge chamber. It comprises quartz glass, doped with 1.0 weight % of barium metaborate ($BaB_2O_4$), 0.5 weight % of ceraluminate ($CeAl_3O_3$), 0.5 weight % of praseodymium oxide ($Pr_6O_{11}$) and 0.05 weight % of titanium oxide ($TiO_2$). The discharge vessel 2 is made undoped quartz glass and is fixed in the lamp base 9 by means of a tubular elongation 8*a* of the pinched end 5*a*. The power lead-in 7*a* near the base extends inside the tubular elongation 8*a* and establishes the electrical contact with one of the two connecting cables 10, while the power lead-in 7*b* remote from the base is electrically conductively connected to the other connecting cable 10 via a return lead 11, which has a ceramic insulation. This lamp is operated in a horizontal position, or other words with the discharge path extending horizontally. The lamp is oriented in such a way that the return lead 11 extends outside the outer bulb 1 (FIG. 2). The outer bulb is eccentric relative to the discharge vessel 2 and relative to the discharge path, which is defined by discharge-side ends of the electrodes. The outer bulb axis A—A extends approximately 0.65 mm above and parallel to the discharge vessel axis and to the discharge path. In FIG. 2, the spacing between the outer bulb axis A—A and the discharge path, or the discharge vessel axis B—B, is shown as exaggeratedly large for the sake of clarity.

Figure 3A:
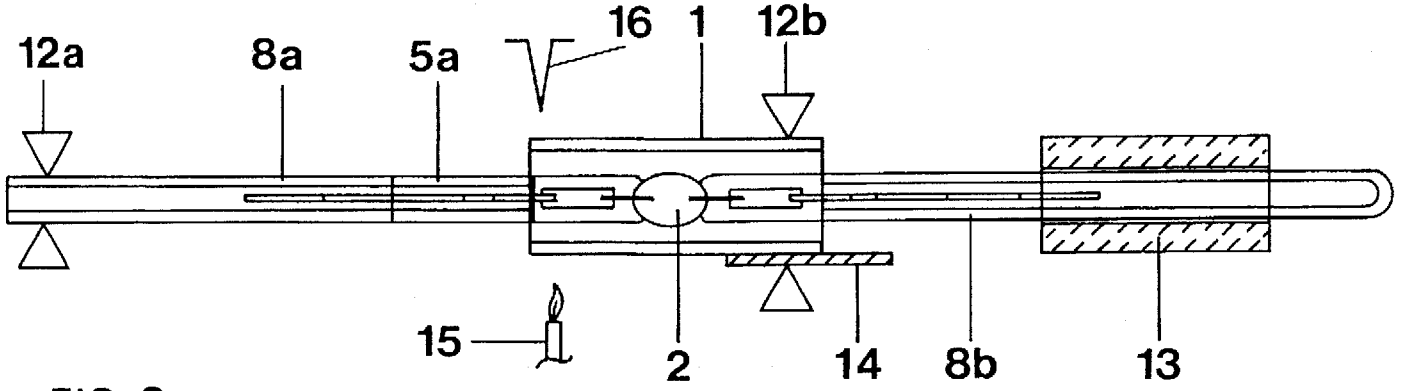
Figure 3B:
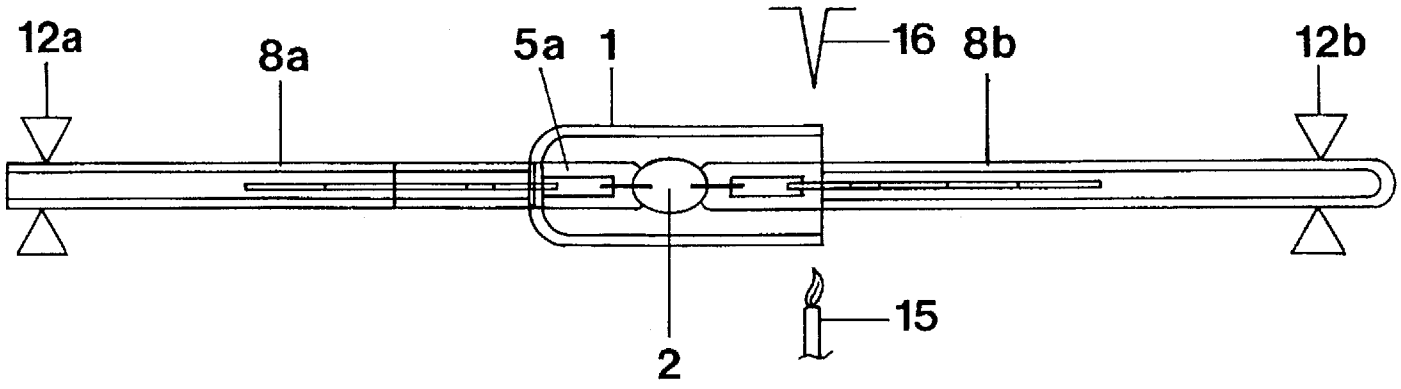

FIGS. 3*a* and 3*b* illustrate the process of producing a high-pressure discharge lamp according to the invention, and especially the assembling of the outer bulb 1. To produce a lamp according to the invention, prefabricated products are used in the form completely prefabricated, substantially axially symmetrical discharge vessel 2 of undoped quartz glass, along with a circular-cylindrical quartz glass tube 1 doped with 1.0 weight % of barium metaborate ($BaB_2O_4$), 0.5 weight % of ceraluminate ($CeAl_3O_3$), 0.5 weight % of praseodymium oxide ($Pr_6O_{11}$) and 0.05 weight % of titanium oxide ($TiO_2$). The discharge vessel 2 has two pinched ends 5*a*, 5*b*, sealed in gas-tight fashion, and two axially extending electrodes 3, which are each electrically conductively connected to a respective power lead-in 7*a*, 7*b* by way of a fused-in molybdenum foil 6. Both power lead-ins extend inside the tubular elongation 8*a*, 8*b* of the pinched ends 5*a*, 5*b*.

For assembling the outer bulb, the quartz glass tube 1 is threaded onto the discharge vessel 2. The discharge vessel 2 is retained by the tubular elongation 8*a* of the pinched end 5*a* in a first clamping chuck 12*a* of a glass lathe, while a counterpart bearing 13 braces the discharge vessel 2 at the other tubular elongation 8*b*.

The glass tube 1 is fixed, together with a shim 14 which is of sheet metal, in a second clamping chuck 12*b*. Both clamping chucks 12*a*, 12*b* of the glass lathe are arranged coaxially. the quartz glass tube 1 is adjusted in such a way that the discharge chamber and both pinched ends 5*a*, 5*b* are enveloped by the glass tube 1. Because of the shim 14, there is an eccentric arrangement of the glass tube 1 relative to the discharge vessel 2, in such a way that the discharge vessel axis B—B and the axis of rotation of the glass tube 1 are shifted parallel relative to one another by the thickness of the shim 14. Since the electrodes 3 are located in the discharge vessel axis B—B and the quartz glass tube 1 forms the outer bulb, this means that the outer bulb axis A—A and the discharge path defined by the electrode heads are likewise shifted parallel to one another by the thickness of the shim 14.

The free end of the quartz glass tube 1, which is not fastened in the clamping chuck 12*b*, is heated by means of an $H_2/O_2$ burner 15 to the softening temperature of the quartz glass tube 1, which is approximately 1540° C., or to a temperature slightly above that, and then rolled with the aid of a cutting roller 16 onto the pinched end 5*a* of the discharge vessel 2 and fused with it. At this temperature, the discharge vessel, made of undoped quartz glass, is still solid, since the softening temperature of the undoped quartz glass is approximately 1750° C., or in other words approximately 200° C. above the softening temperature of the quartz glass tube 1. In this way, the free end of the glass tube 1 is sealed and fixed to the discharge vessel 2. During the fusing of the quartz glass tube 1 and the pinch seal 5*a*, the two clamping chucks 12*a*, 12*b* rotate in synchronism.

The other, still-open end of the quartz glass tube 1 is sealed in the same way by heating using an $H_2/O_2$ burner 15 see FIG. 3*b*. To that end, the two tubular elongations 8*a*, 8*b* of the discharge vessel 2 are fastened in the clamping chucks 12*a*, 12*b* of the glass lathe. The glass tube 1 during this melting process is fixed by its already sealed end on the discharge vessel 2, and so it need not be retained in a retaining device of the glass lathe.

The quartz glass tube 1 used in this exemplary embodiment has an inner diameter of approximately 8.8 mm, a wall thickness of 1.0 mm, and a length of 25 to 32 mm. The length of the prefabricated discharge vessel 2, including its tubular elongations is about 150 mm, its inner diameter is about 2.3 mm, its wall thickness is about 1.3 mm, and the electrode spacing is about 4 to 5 mm. In this exemplary embodiment, 0.65 mm has been ascertained as the most favorable value for the spacing between the outer bulb axis A—A and the discharge path or discharge vessel axis B—B.

After the assembly of the outer bulb, the tubular elongation 8*b* is severed from the discharge vessel, while the other tubular elongation 8*a* is shortened and is used to secure the high-pressure discharge lamp in its base. Securing of the lamp in its base is described for instance in EP-A 455 884 and will therefore not be described in further detail here.

The invention is not limited to the exemplary embodiment described in detail here. For instance, as the outer bulb glass, it is also possible to use a quartz glass that has only a viscosity-reducing dopant, but no UV-radiation-absorbing dopant. Examples of such quartz glasses suitable as glass for the outer bulb may be found in U.S. Pat. No. 5,532,195, issued from Ser. No. 08/595,408. As a dopant that absorbs UV rays, other rare earth metal additives than those disclosed in the exemplary embodiment may also be used. For rare earth metal additives, the UV-ray-absorbing dopant logically varies within the range from about 0.1 to 1.5 weight %, and for titanium oxide it ranges from about 0 to 0.15 weight %. The weight percentages given are always relative to the undoped quartz glass. The viscosity-lowering alkaline earth metal borate content, especially the barium metaborate content, in the quartz glass is suitably about 0.05 to 2.0 weight %. Besides barium metaborate, it is naturally also possible to use weight %. Besides barium metaborate, it is naturally also possible to use other viscosity-lowering quartz glass dopants. If the rare earth metal dopant in the quartz glass is adequately high, then the alkaline earth metal borate additives can be reduced or even omitted entirely, since the rare earth metal dopant in the quartz glass likewise has a viscosity-lowering effect.

We claim:

1. A high-pressure discharge lamp, comprising a discharge vessel (2) of quartz glass, sealed on two ends, which is surrounded by an outer bulb (1), two electrodes (3) having spaced ends, located inside the discharge vessel (2);

two pinch seals (5*a*, 5*b*), one at each end of the discharge vessel (2), characterized in that the outer bulb (1) comprises a glass that has a lower softening temperature than the quartz glass of the discharge vessel (2); and the outer bulb (1) is fused to the pinch seals (5*a*, 5*b*) of the discharge vessel.

2. The high-pressure discharge lamp of claim 1, characterized in that the outer bulb envelope (1) comprises quartz glass which is provided with dopants that reduce the softening temperature of the quartz glass.

3. The high-pressure discharge lamp of claim 2, characterized in that the dopants contain alkaline earth metal borates.

4. The high-pressure discharge lamp of claim 2, characterized in that the dopants contain rare earth metals or rare earth metal compounds.

5. The high-pressure discharge lamp of claim 3, characterized in that the quartz glass of the outer bulb (1) is doped with from 0.05 to 2.0 weight % of barium metaborate ($BaB_2O_4$).

6. The high-pressure discharge lamp of claim 4, characterized in that the quartz glass of the outer bulb (1) is doped with from 0.1 to 1.5 weight % of ceraluminate ($CeAl_3O_3$).

7. The high-pressure discharge lamp of claim 4, characterized in that the quartz glass of the outer bulb (1) is doped with from 0.1 to 1.5 weight % of praseodymium oxide.

8. The high-pressure discharge lamp of claim 1, characterized in that the outer bulb (1) is substantially rotationally symmetrical, and its axis of symmetry is shifted parallel, relative to a straight line extending through the electrode ends, by an amount that is determined by the gravitation-dictated upward curvature of the discharge arc, given a horizontal operating position of the lamp.

9. A process for producing a high-pressure discharge lamp of claim 1, characterized in that the production process includes the following manufacturing steps:

production of a discharge vessel (2) with an ionizable filling enclosed in it and with said two gas-tight pinch seals (5*a*, 5*b*) at the ends of the discharge vessel, in each of which an axially located electrode (3) is fused in;

threading and adjustment of a glass tube (1) of a glass that has a lower softening temperature than the quartz glass of the discharge vessel onto the discharge vessel (2), so that the glass tube (1) at least partially covers both pinch seals (5*a*, 5*b*) of the discharge vessel;

heating the ends of the glass tube to softening temperature and rolling of the softened ends of the glass tube (1) onto the pinch seals (5*a*, 5*b*) of the discharge vessel.

10. The process for producing a high-pressure discharge lamp of claim 9, characterized in that the pinch seals (5*a*, 5*b*) of the discharge vessel (2) enclose molybdenum foils (6) sealed therein, and the step of heating and rolling comprises fusing the outer bulb (1) to the pinch seals (5*a*, 5*b*).

11. The process of claim 9, wherein the pinch seals (5a, 5b) include molybdenum foils (6) sealed therein; and said step of heating and rolling the softened ends of the glass tube onto the pinch seals (5a, 5b) comprises rolling and fusing the softened ends of the glass tube (1) to the pinch seals in the immediate vicinity of the ends of the molybdenum foils remote from a discharge chamber formed by said discharge vessel.

12. The high-pressure discharge lamp of claim 1, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

13. The high-pressure discharge lamp of claim 2, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

14. The high-pressure discharge lamp of claim 3, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

15. The high-pressure discharge lamp of claim 4, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

16. The high-pressure discharge lamp of claim 5, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

17. The high-pressure discharge lamp of claim 6, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

18. The high-pressure discharge lamp of claim 7, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

19. The high-pressure discharge lamp of claim 8, wherein the pinch seals (5a, 5b) include molybdenum foils (6) sealed therein; and the outer bulb (1) is fused to the pinch seals in the immediate vicinity of the ends of the molybdenum foils (6) remote from a discharge chamber formed by said discharge vessel.

20. The high-pressure discharge lamp of claim 1, characterized in that the outer bulb envelope (1) comprises quartz glass which is provided with dopants that reduce the softening temperature of the quartz glass;

in that the outer bulb (1) is substantially rotationally symmetrical, and its axis of symmetry is shifted parallel, relative to a straight line extending through the electrode ends, by an amount that is determined by the gravitation-dictated upward curvature of the discharge arc, given a horizontal operating position of the lamp; and wherein the pinch seals (5a, 5b) include molybdenum foils (6) sealed therein; and the outer bulb (1) is fused to the pinch seals (5a, 5b) in the immediate vicinity of the ends of the molybdenum foils (6) remote from a discharge chamber formed by said discharge vessel.

* * * * *